United States Patent [19]

Shurtleff

[11] 4,002,301

[45] Jan. 11, 1977

[54] VENTED HAMMERMILL CRUSHER

[75] Inventor: George S. Shurtleff, Coon Rapids, Minn.

[73] Assignee: Baker Oil Tools, Inc., Los Angeles, Calif.

[22] Filed: Nov. 6, 1975

[21] Appl. No.: 629,286

[52] U.S. Cl. ..... 241/48; 241/185 R

[51] Int. Cl.[2] ..... B02C 23/34

[58] Field of Search ..... 241/47, 48, 49, 51, 241/53, 55, 57, 73, 185 R, 186.2, 189 R

[56] References Cited

UNITED STATES PATENTS

| | | | |
|---|---|---|---|
| 2,045,582 | 6/1936 | Clement | 241/51 |
| 2,957,633 | 10/1960 | Andreas | 241/186.2 |

*Primary Examiner*—Granville Y. Custer, Jr.
*Attorney, Agent, or Firm*—Trask & Britt

[57] ABSTRACT

An enclosed hammermill crusher having a closed-loop vent is described. The crusher-enclosure has an upper vent opening in the housing above the hammers where the hammer direction is upward, said vent opening communicating with a closed-loop vent duct. The lower part of the crusher housing is contiguous with a crushed particulate collector which has sloping sides and a small discharge opening cummunicating with a discharge conduit. The lower end of the vent duct connects to the discharge conduit near the collector discharge opening, preferably at about right angles to the discharge conduit. The inlet opening for aggregate material in the top of the housing is above the hammers where said hammers have a downward direction.

7 Claims, 3 Drawing Figures

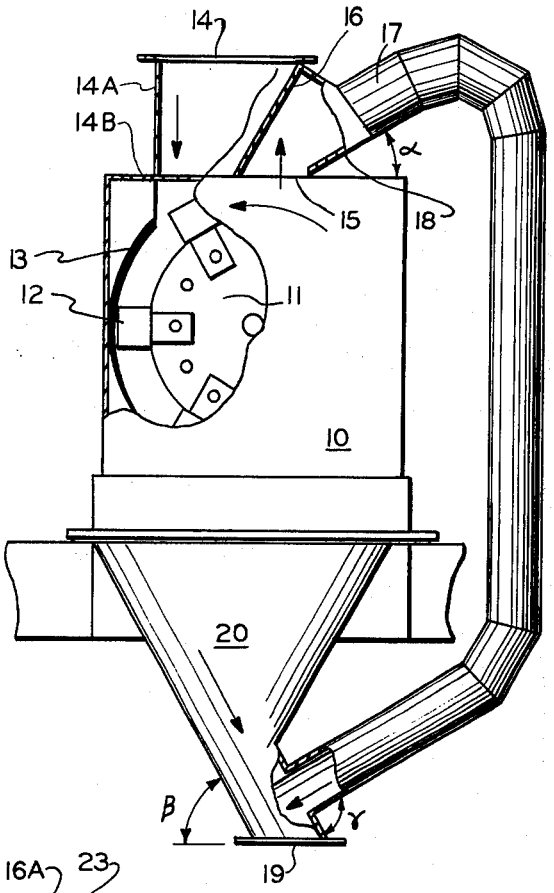
FIG. 1
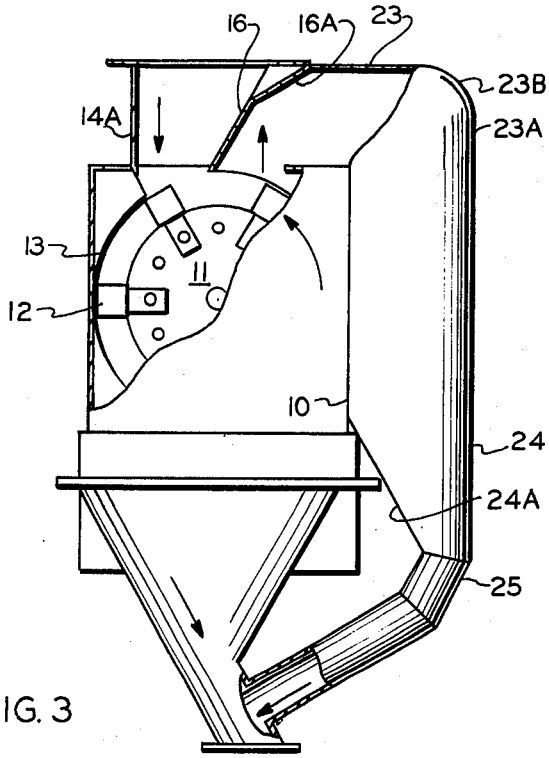
FIG. 3
FIG. 2
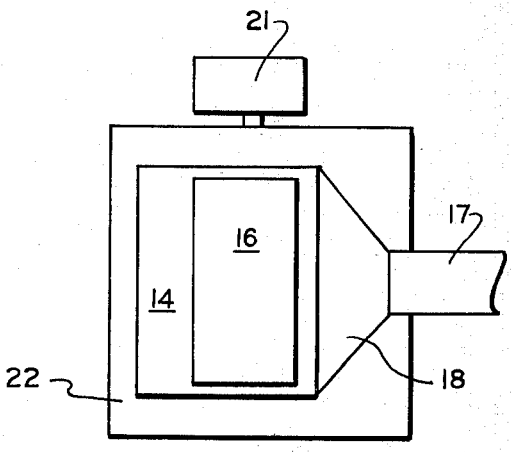

VENTED HAMMERMILL CRUSHER

BACKGROUND OF INVENTION

1. Field

This invention relates to hammermill crushers, which are used in the mineral industries for reducing the size of aggregate to a fine size, i.e., a mesh size of about 8 to about 200. Because of the fineness of the mill product, "dusting" or loss of fine material has been a long-standing problem. The "dusting" of "fines" lost from the mill may present a maintenance and/or cleaning problem in production equipment. Furthermore, for a mill in a sampling line the loss of any material may introduce an error into the sample analyses. Part of the dusting problem results because conventional hammermills act as an air-pump, drawing air into the system by the rapid rotation of the hammers.

Introduction of large quantities of air into a particulate sampling system further aggrevates thedusting problem and tends to dry the particulate material, which causes an erroneous indication of moisture content. Although these problems have existed, hammermills have an important function in particulate sampling systems because of their compactness, efficiency in reducing particle size, reliability in producing particles of a constant size distribtuion and uniformity of size, and ability to effect a substantial particle size reduction to a fine particle size.

OBJECTS OF INVENTION

It is an object of the invention to provide a hammermill crusher which has the ability to operate without a dusting problem.

A further object of the invention is to provide a hammermill which operates without an undue loss of material.

Another object of the instant invention is to provide a hammermill which operates without throwing undue quantities of air into the system.

DESCRIPTION OF DRAWINGS

FIG. 1 is an elevational view of the vented hammermill crusher of this invention.

FIG. 2 is a plan view of a vented hammermill crusher.

FIG. 3 is a plan view of an alternative construction for a vented hammermill crusher.

DESCRIPTION OF INVENTION

An enclosed hammermill crusher having a closed-loop vent system has been invented. The crusher enclosure has an upper vent opening in the housing above the hammers where the hammer direction is upward. This vent opening communicates with a closed-loop vent duct which communicates with the discharge conduit connected at the bottom of the crusher housing. The lower part of the crusher housing is contiguous with a crushed particulate collector which has sloping sides and is preferably conical or pyramidal in shape. A lower end of the vent duct connects with the discharge conduit near the collector discharge opening, preferably at right angles to the discharge conduit. The inlet opening for aggregate material in the top of the housing is above the hammer where said hammer has a downward direction.

In FIG. 1, an elevational view of the vented hammermill crusher of this invention, the crusher housing 10 is cutaway to expose the rotor 11 with hammers 12 attached near the periphery. The hammers are thrown by centrifugal force, created during rotation of the rotor, to pass close to the cylindrical shaped striking plate 13 to crush material to a very fine powder. The striking plate may be discontinuous near the housing base or it may have very fine holes therein to allow the pulverized material to escape into collector means.

The inlet opening to the system for aggregate material is through opening 14. An exit opening for discharge of air and circulation of fines is through opening 15 wherein the air is traveling upward and strikes deflector plate 16 and is deflected into the closed-loop vent 17.

Deflector plate 16 serves two functions in the construction illustrated in FIG. 1. First, it provides a wall for hopper **14*a* so that the upper opening of the hopper is large to provide easy access to large volumes of large aggregate and a smaller lower opening into the mill to direct the aggregate into the proper area for pulverizing, i.e., about the mid-point of the mill. Second, the deflector plate 16 is provided at an angle of about 60° to about 70° to the top plate 14*b* of the mill to deflect the circulating air into vent 17.**

The bottom of the deflector plate 16 is located within plus or minus 10° of the crusher center line, i.e., as viewed in FIG. 1. The center line passes vertically through the axle of the rotor. The bottom of the deflector plate is preferably located directly over the rotor axle and parallel thereto, The vent exit housing 18 is constructed so that is has a base section at an angle alpha to the flat top of the hammermill housing. The angle alpha preferably has a minimum angle of about 20° and a maximum angle of about 60°. It has been found that the vent pipe 17 connected to the exit vent housing 18 preferably extends for a short distance without having any curves in the vent pipe so as to permit the air discharging through the vent housing 18 to continue the direction provided by vent housing 18 without an immediate change in direction of flow. Vent duct 17 forms a closed-loop connecting with the discharge pipe 19 at a point just below the discharge opening from the conical or pyramidal shaped hopper 20. The vent pipe 17 preferably meets the discharge pipe 19 at an angle of about 90° as indicated by the angle gamma on FIG. 1. The angle of the discharge pipe 19 to the horizontal is preferably from about 45° to about 70° and preferably 60°, as indicated by the angle beta in FIG. 1.

For commercially sized hammermills having a rotor diameter of about 20 inches, or larger, a vent duct 17 having a minimum diameter of six inches is preferred.

FIG. 2, a plan view of the vented hammermill crusher of this invention, illustrates the vent discharge housing 18 connected to the vent pipe 17 and shows deflector plate 16 in the inlet opening 14. A motor 21 drives the rotor. The top of the hammermill housing 22 is preferably a flat plate which supports the vent discharge housing 18.

The size of the inlet and outlet opening depend upon the size of the hammermill. Also, the diameter of the vent depends upon the size of the hammermill. Generally, these openings and vent pipe may be greatly oversized without affecting the operation of the system. However, providing an under-sized opening and an under-sized vent pipe builds up a back pressure which defeats the operation of the system.

As indicated hereinabove, a minimum vent diameter is preferred for hammermills with a rotor size of 20 inches.

FIG. 3 illustrates an alternative structure for the vented hammermill crusher wherein a substantial portion of the vent means is made an integral part of the crusher housing. Hopper 14*a* and deflector plate are of similar construction and location as previously indicated. A second supplemental deflector plate 16*a* is located within the integral upper vent duct 23 is slightly deflect the exhausting materials into chamber 23*a* which has a curved outer wall 23*b* to turn the exhaust stream downward into integral vertical vent duct 24 which uses one wall of housing 10 as a duct wall. A deflector plate 24*a* directs the exhaust into lower vent 25 which is similar in size, location and shape to the lower portion of vent 17 illustrated in FIG. 1.

The structure of the mill of FIG. 3 is advantageous in that it is compact and uses portions of the housing as portions of the duct. The structure of FIG. 3, however, must provide a clean-out door in the side of the duct to provide access to the clean-out door normally located on the side of the hammermill where the direction of the hammers is upward. The duct still may be hinged along a vertical hinge to swing away from the hammermill housing to expose the clean-out door.

I claim:

1. A vented hammermill crusher comprising:

a. a housing and rotary crusher means having an upper inlet opening above that portion of the rotary crusher means where the crusher direction is downward, a vent opening above that portion of the rotary crusher means where the crusher direction is upwards, b. a crusher particulate collector having a large upper opening communicating with the housing bottom, said collector having sloping sides and a small discharge opening, c. a discharge conduit communicating with the discharge opening of the collector, said conduit having substantially the same angle as the collector wall relative to the horizontal and having an opening therein, d. a vent duct external to said housing connecting said vent opening of the crusher housing and the opening in the discharge conduit, said vent duct connecting to said discharge conduit at an angle of about 90° to the discharge conduit sidewall.

2. The vented crusher of claim 1 wherein said collector sloping sides have a slope of from about 45° to 60° to the vertical.

3. The vented crusher of claim 1 wherein said upper opening and said vent opening are separated by a deflector plate.

4. The vented crusher of claim 1 wherein said crusher housing has sidewalls and a top cover, said top cover having said vent opening therein closely adjacent the crusher means.

5. The vented crusher of claim 1 wherein said deflector plate is disposed at an angle of about 60° to about 70° with respect to the top cover of said housing

6. The vented crusher of claim 1 wherein said vent opening communicates with a vent housing having an angularly disposed delfector plate and vent duct extending from said vent housing in a substantially straight line for a short distance.

7. The vented crusher of claim 1 wherein said vent duct has a wall in common with an outer wall of said crusher housing.

* * * * *